US009108452B2

(12) United States Patent
Takemoto et al.

(10) Patent No.: US 9,108,452 B2
(45) Date of Patent: Aug. 18, 2015

(54) METHOD OF MANUFACTURING RECORDED MATTER, MANUFACTURING DEVICE OF RECORDED MATTER AND RECORDED MATTER

(71) Applicant: Seiko Epson Corporation, Tokyo (JP)

(72) Inventors: Kiyohiko Takemoto, Matsumoto (JP); Akio Ito, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 79 days.

(21) Appl. No.: 13/788,998

(22) Filed: Mar. 7, 2013

(65) Prior Publication Data

US 2013/0235136 A1 Sep. 12, 2013

(30) Foreign Application Priority Data

Mar. 7, 2012 (JP) ..... 2012-050116

(51) Int. Cl.

| | |
|---|---|
| ***B41J 2/01*** | (2006.01) |
| ***B41M 5/50*** | (2006.01) |
| ***B41M 5/025*** | (2006.01) |
| ***B41M 5/035*** | (2006.01) |

(52) U.S. Cl.

CPC ..... *B41M 5/50* (2013.01); *B41M 5/0256* (2013.01); *B41M 5/035* (2013.01)

(58) Field of Classification Search

CPC ..... B41J 2002/012; B41J 2/0057

See application file for complete search history.

(56) References Cited

U.S. PATENT DOCUMENTS

| | | | | |
|---|---|---|---|---|
| 5,623,296 | A | 4/1997 | Fujino et al. | |
| 7,360,887 | B2 * | 4/2008 | Konno | 347/103 |
| 2002/0175986 | A1 * | 11/2002 | Miyamoto | 347/106 |
| 2005/0110856 | A1 | 5/2005 | Mouri et al. | |
| 2005/0270351 | A1 | 12/2005 | Mouri et al. | |
| 2006/0238592 | A1 | 10/2006 | Kadomatsu et al. | |
| 2009/0079808 | A1 * | 3/2009 | Uemura et al. | 347/103 |
| 2009/0207198 | A1 | 8/2009 | Muraoka | |
| 2009/0244146 | A1 * | 10/2009 | Chiwata | 347/14 |
| 2009/0317555 | A1 * | 12/2009 | Hori | 427/428.06 |
| 2010/0156971 | A1 | 6/2010 | Ikeda et al. | |
| 2010/0245510 | A1 | 9/2010 | Ageishi | |
| 2011/0048324 | A1 | 3/2011 | Yamashita et al. | |
| 2011/0181675 | A1 | 7/2011 | Takemoto | |

(Continued)

FOREIGN PATENT DOCUMENTS

| | | |
|---|---|---|
| JP | 62-001426 B2 | 1/1987 |
| JP | 03-056573 A | 3/1991 |

(Continued)

*Primary Examiner* — Matthew Luu

*Assistant Examiner* — Tracey McMillion

(74) *Attorney, Agent, or Firm* — Nutter McClennen & Fish LLP; John J. Penny, Jr.; Joshua I. Rudawitz

(57) ABSTRACT

Provided is a method of manufacturing a recorded matter including applying a first ink including a volatile first liquid to an intermediate transfer medium; applying a second ink including a coloring agent, a thermoplastic resin and a volatile second liquid using an ink jet method to locations of the intermediate transfer medium where the first ink is applied; heating the surface of the intermediate transfer medium where the second ink is applied from the opposite surface side and volatilizing at least a part of the second liquid; transferring the second ink heated of the surface of the intermediate transfer medium onto the recording medium; and heating the second ink transferred to the recording medium of the surface of the intermediate transfer medium.

16 Claims, 1 Drawing Sheet

(56) References Cited

U.S. PATENT DOCUMENTS

| | | | | |
|---|---|---|---|---|
| 2011/0227990 | A1* | 9/2011 | Kuwabara et al. | 347/20 |
| 2011/0230623 | A1 | 9/2011 | Hirano et al. | |
| 2012/0013694 | A1 | 1/2012 | Kanke | |
| 2012/0055361 | A1 | 3/2012 | Takemoto | |
| 2012/0058285 | A1 | 3/2012 | Takemoto | |
| 2012/0156444 | A1 | 6/2012 | Takemoto et al. | |
| 2013/0235116 | A1 | 9/2013 | Takemoto | |

FOREIGN PATENT DOCUMENTS

| | | | |
|---|---|---|---|
| JP | 03-079678 | A | 4/1991 |
| JP | 03-160068 | A | 7/1991 |
| JP | 04-018462 | A | 1/1992 |
| JP | 10-202998 | A | 8/1998 |
| JP | 3177985 | B2 | 6/2001 |
| JP | 2006-130725 | A | 5/2006 |
| JP | 2011-110793 | A | 6/2011 |
| JP | 2011-173405 | A | 9/2011 |
| JP | 2012-051286 | A | 3/2012 |
| JP | 2012-051287 | A | 3/2012 |
| JP | 2012-051293 | A | 3/2012 |
| JP | 2012-126025 | A | 7/2012 |
| JP | 2012-126026 | A | 7/2012 |

* cited by examiner

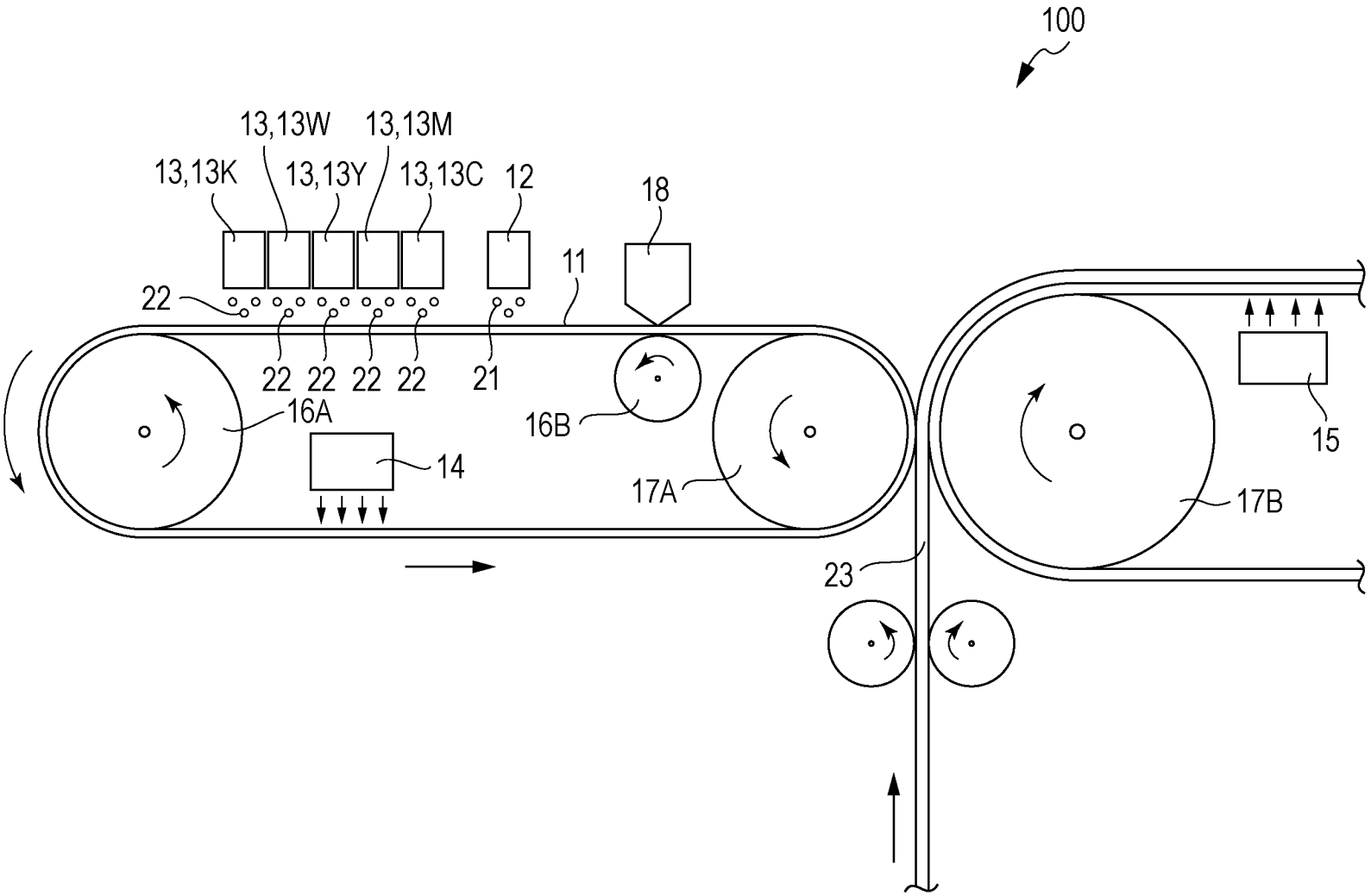
100
15
17B
23
18
17A
16B
11
12
21
13,13C
13,13M
13,13Y
13,13W
13,13K
22
14
16A

METHOD OF MANUFACTURING RECORDED MATTER, MANUFACTURING DEVICE OF RECORDED MATTER AND RECORDED MATTER

BACKGROUND

1. Technical Field

The present invention relates to a method of manufacturing a recorded matter, a manufacturing device of a recorded matter and a recorded matter.

2. Related Art

As a method of manufacturing a recorded matter, a method using an ink jet method is widely used. The ink jet method is excellent on the points that a minute pattern may be appropriately formed, a plate is unnecessary, and the method may appropriately correspond to small lot production and multi-product production.

However, in a case in which direct printing is performed on a recording medium using the ink jet method, according to the type of recording medium (for example, a non-absorbent medium, such as a recording medium made of plastic which is not provided with an ink absorbing layer), there are problems such as flowing or cissing of the ink on the recording medium occurring, time being required for drying (hardening) of the ink applied to the medium, disturbance occurring in the undried (unhardened) ink image during the discharge or the like of the recording medium to which ink is applied, and it is difficult to reliably form a printing portion in a desired shape.

In order to solve these problems, an intermediate transfer method of recording method is used (for example, refer to Japanese Patent No. 3177985).

However, in the related art, it is difficult to sufficiently prevent the above problems from occurring, even using the intermediate transfer method of recording method. In addition, in the intermediate transfer method of recording method in the related art, there is a problem that it is difficult to make the fixity of the printing portion to the recording medium sufficiently superior.

In particular, the above tendency occurs remarkably in a case where a film material manufactured of plastic and used as a packaging or the like for a product is used as the recording medium.

SUMMARY

An advantage of some aspects of the present invention is to provide a method of manufacturing a recorded matter capable of reliably and efficiently manufacturing a recorded matter provided with a printing portion having superior fixity and a desired shape, to provide a manufacturing device of a recorded matter capable of reliably and efficiently manufacturing a recorded matter provided with a printing portion having superior fixity and a desired shape and, in addition, to provide a recorded matter provided with a printing portion having superior fixity and a desired shape.

The advantage is achieved by the invention described below.

According to an aspect of the invention, there is provided a method of manufacturing a recorded matter including applying a first ink including a volatile first liquid to an intermediate transfer medium; applying a second ink including a coloring agent, thermoplastic resin and a volatile second liquid using an ink jet method to locations of the intermediate transfer medium to which the first ink is applied; heating the surface of the intermediate transfer medium to which the second ink is applied from the opposite surface side, and volatilizing at least a part of the second liquid; transferring the second ink heated of the surface of the intermediate transfer medium onto the recording medium; and heating the second ink transferred to the recording medium.

In so doing, the method of manufacturing the recorded matter may be provided which is able to reliably and efficiently manufacture the recorded matter provided with a printing portion having excellent fixity and a desired shape.

In the method of manufacturing a recorded matter according to the aspect of the invention, it is preferable that the boiling point $T_{bp1}$ of the first liquid be 50° C. or higher to 150° C. or lower.

In so doing, it is possible to more reliably prevent the occurrence an adverse influence due to remaining of first liquid on the recorded matter finally obtained, and to make the transferability of the second ink from the intermediate transfer medium to the recording medium more reliably superior.

In the method of manufacturing a recorded matter according to the aspect of the invention, it is preferable that the first ink cause the surface free energy of the intermediate transfer medium to be reduced.

In so doing, it is possible to make the transferability of the second ink from the intermediate transfer medium to the recording medium particularly superior, to more reliably form a printing portion in a desired shape and to make the productivity of the recorded matter particularly superior.

In the method of manufacturing a recorded matter of the aspect of the invention, it is preferable that surface tension of the first ink be lower than surface tension of the intermediate transfer medium and lower than surface tension of the second ink.

In so doing, forming a film using a uniform first ink in the applying of the first ink, since it is possible in the second ink application to prevent involuntary spreading wetness of the second ink on the intermediate transfer medium, it is possible to more appropriately perform transfer from the intermediate transfer medium to the recording medium of the pattern using the second ink and to make the pattern using the second ink more reliably in a desired shape.

In the method of manufacturing a recorded matter according to the aspect of the invention, it is preferable that the first liquid be a monovalent alcohol.

In so doing, it is possible to make the transferability of the second ink from the intermediate transfer medium to the recording medium particularly superior to more reliably form a printing portion in a desired shape, and to make the productivity of the recorded matter particularly superior. In addition, it is possible to more reliably prevent first liquid remaining on the recorded matter finally obtained. In addition, ethanol is a material which is able to reliably exhibit the effects of some aspects of the invention even in a case of small usage amounts, and additionally has little burden on the environment. Accordingly, it is preferable from the viewpoint of environmental protection.

In the method of manufacturing a recorded matter according to the aspect of the invention, it is preferable that the boiling point $T_{bp2}$ of the second liquid be 70° C. or higher to 150° C. or lower.

In so doing, of the surface of the intermediate transfer medium, the second liquid may be moderately volatilized, and it is possible to more reliably prevent the first liquid volatilizing of the surface of the intermediate transfer medium and to more effectively improve the stability of the shape of the second ink. In addition, in the second heating of the second ink, the second liquid may be more reliably removed, and it is possible to more reliably prevent the occurrence of adverse influence due to remaining of the second liquid on the recorded matter ultimately obtained.

In the method of manufacturing a recorded matter of the aspect of the invention, it is preferable that the second ink include water as the second liquid.

In so doing, of the surface of the intermediate transfer medium, the second liquid may be moderately volatilized, and it is possible to more reliably prevent the first liquid volatilizing of the surface of the intermediate transfer medium and to more effectively improve the stability of the shape of the second ink. In addition, in the second heating of the second ink, the second liquid may be more reliably removed, and it is possible to more reliably prevent the occurrence of adverse influence due to remaining of the second liquid on the recorded matter ultimately obtained. In addition, water is a material with particularly small burden on the human body or the environment. Accordingly, it is preferable from the viewpoint of worker safety and environmental protection.

In the method of manufacturing a recorded matter according to the aspect of the invention, it is preferable that the applying of the first ink be performed using an ink jet method.

In so doing, the first ink may be applied efficiently and selectively to a predetermined region (region corresponding to a region to which second ink is applied) of the intermediate transfer medium, and it is possible to suppress the usage amount of first ink while making the productivity of the recorded matter particularly superior, and is preferable from the viewpoint of resource savings.

In the method of manufacturing a recorded matter according to the aspect of the invention, in the locations to which second ink is transferred in the transferring, it is preferable that the curvature rate of the intermediate transfer medium be larger than the curvature rate of the recording medium.

In so doing, the transferring may be more efficiently performed, and it is possible to make the productivity and the yield of the recorded matter particularly superior. In addition, it is possible to make the fixing strength in the printing portions of the recorded matter particularly superior.

In the method of manufacturing a recorded matter according to the aspect of the invention, in the locations in which second ink is transferred in the transferring, it is preferable that the intermediate transfer medium and the recording medium be mutually curved in a convex shape towards the other side.

In so doing, the transferring may be more efficiently performed, and it is possible to make the productivity and the yield of the recorded matter particularly superior. In addition, it is possible to make the fixing strength in the printing portions of the recorded matter particularly superior. In addition, there are advantages from the viewpoint of size reductions of a manufacturing device used in the manufacturing of a recorded matter.

In the method of manufacturing a recorded matter according to the aspect of the invention, it is preferable that the second heating of the second ink be performed by heating the side of the recording medium to which the second ink is transferred from the surface of the opposite side.

In so doing, the parts of the second ink contacting the recording medium may be softened more reliably and more efficiently, and it is possible to make the fixing strength with respect to the printing portion of the recording medium, and the durability and reliability of the recorded matter particularly superior.

In the method of manufacturing a recorded matter according to the aspect of the invention, it is preferable that the recording medium be a film configured from a plastic material.

In the related art, in a case where the recording medium is a film composed from the plastic material, it is difficult to reliably form printing portions in a desired shape, and additionally, problems of it being difficult to make the fixity of the printing portions to the printing medium sufficiently superior occur particularly remarkably. In contrast, according to the aspect of the invention, it is possible to reliably prevent the occurrence of the above problems even in cases where the recording medium is the film composed from the plastic material. In other words, in a case where the recording medium is the film composed from the plastic material, the effects according to the aspect of the invention are more remarkably exhibited.

According to another aspect of the invention, there is provided a manufacturing device of a recorded matter including an intermediate transfer medium; a first ink application unit applying a first ink including a volatile first liquid to the intermediate transfer medium; a second ink application unit applying a second ink including a coloring agent, a thermoplastic resin and a volatile second liquid using an ink jet method to locations of the intermediate transfer medium to which the first ink is applied; a first heating unit heating a surface of the intermediate transfer medium to which the second ink is applied from the opposite surface side; and a second heating unit heating the second ink transferred to a recording medium.

In so doing, the manufacturing device of the recorded matter may be provided which is able to reliably and efficiently manufacture a recorded matter provided with a printing portion having superior fixity and a desired shape.

According to still another aspect of the invention, there is provided a recorded matter which is manufactured using the method of the aspect of the invention.

In so doing, the recorded matter may be provided with superior fixity and include printing portions having a desired shape.

BRIEF DESCRIPTION OF THE DRAWING

The invention will be described with reference to the accompanying drawing, wherein like numbers reference like elements.

FIGURE is a configuration diagram schematically showing a preferred embodiment of a manufacturing device of a recording medium according to the invention.

DESCRIPTION OF EXEMPLARY EMBODIMENTS

Manufacturing Method and Manufacturing Device of Recorded Matter

First, a manufacturing method and manufacturing device of the recorded matter according to the invention will be described.

A manufacturing method of a recorded matter according to the invention includes a first ink application step applying a first ink including a volatile first liquid to an intermediate transfer medium; a second ink application step applying a second ink including a coloring agent, a thermoplastic resin and a volatile second liquid using an ink jet method to locations of the intermediate transfer medium in which the first ink is applied; a first heating step in which a surface of the intermediate transfer medium to which the second ink is applied is heated from the opposite surface side and at least a part of the second liquid is volatilized; transferring step in which the second ink heated in the first heating step is transferred onto the recording medium; and a second heating step in which the second ink transferred to a recording medium is heated.

In this way, by applying the first ink to a region to which the second ink including a coloring agent and a thermoplastic resin is to be applied, before transferring to the recording medium, and heating the surface of the intermediate transfer medium to which the second ink is applied in advance from the opposite surface side and volatilizing at least a part of the second liquid, it is possible to make the efficiency of transfer of the second ink to the recording medium from the intermediate transfer medium while reliably preventing involuntary deformation of the pattern using the second ink, and as a result, it is possible to reliably and efficiently manufacture a recorded matter having printing portions with a desired shape.

In other words, before transfer to the recording medium, by volatilizing at least a part of the second liquid through heating, since the content rate of solids increases, the stability of the shape of the second ink improves and during transfer and the like, it is possible to reliably prevent disturbance occurring in the pattern using the second ink. In particular, by heating the surface of the intermediate transfer medium to which second ink is applied from the opposite surface side, it is possible to reliably prevent only the outer surface of the second ink being dried, and the liquid (second liquid) being trapped within the film-like second ink, and an effect of stabilizing the shape of the second ink is exhibited. In addition, by the first ink being applied to the intermediate transfer medium in advance, the release characteristics from the intermediate transfer medium of the second ink during transfer become excellent. In particular, it is possible to make the content rate of the second liquid low in a region in the vicinity of the surface of the second ink opposing the intermediate transfer medium, it is possible to cause second liquid to remain in the vicinity of the outer surface (surface of the opposite side to the side opposing the intermediate transfer medium) of the second ink while making the release characteristics of the second ink from the intermediate transfer medium excellent, and the fixity of the second ink to the recording medium may be made excellent. Furthermore, adverse effects, such as the first liquid, because of having volatility, remaining on the surface of the manufactured recorded matter, the printing portion being softened, and the stability of the shape being decreased are reliably prevented. In other words, in an aspect of the invention, the above effects act synergistically, and a printing material including printing portions having a desired shape may be reliably and efficiently manufactured.

On the other hand, the invention further has a second heating step in which the second ink is heated, after transfer to the recording medium. Accordingly, it is possible to soften the thermoplastic resin forming the second ink after transfer to the recording medium, and make the fixity of the printing portions with respect to the recording medium sufficiently superior in the recorded matter ultimately obtained. Moreover, the first liquid also has volatility, similarly to the second liquid; however, because the outer surface of the first ink on the intermediate transfer medium is covered by the outer surface of the second ink, the volatilizing of the first liquid is prevented in the first heating step, and the above effects due to the first liquid are reliably exhibited.

Below, preferred embodiments of a method of manufacturing a recorded matter and a manufacturing device of the same will be described in greater detail while referencing the attached drawings.

FIGURE is a configuration diagram schematically showing a preferred embodiment of the manufacturing device of the recorded matter according to the invention. Moreover, portions of the configuration shown in the drawing referred to in the specification are shown exaggerated, and do not accurately reflect actual dimensions.

As shown in FIG. 1, a manufacturing device 100 includes an intermediate transfer medium 11, a first ink application unit 12 applying a first ink 21 to the intermediate transfer medium 11, a second ink application unit 13 applying a second ink 22, a first heating unit 14 heating the second ink 22 on the intermediate transfer medium 11, and a second heating unit 15 heating a second ink 22 transferred onto a recording medium 23.

In the configuration shown in the drawing, the intermediate transfer medium 11 is in the form of an endless belt. Further, the intermediate transfer medium 11 is supported so as to rotate while tension is applied thereby from the inner circumferential surface side by support rollers 16A and 16B and a press roller 17A. In addition, the intermediate transfer medium 11 has a width the same as or greater than the recording medium 23.

Examples of the constituent material of the intermediate transfer medium 11 include, for example, various types of resin (for example, polyimide, polyamide-imide, polyester, polyurethane, polyamide, polyethersulfone, fluorine-based resins and the like), various types of rubber (for example, nitrile rubber, ethylene propylene rubber, chloroprene rubber, isoprene rubber, styrene rubber, butadiene rubber, butyl rubber, chlorosulfonated polyethylene, urethane rubber, epichlorohydrin rubber, acrylic rubber, silicone rubber, fluorine rubber or the like), various metallic materials, or the like. The intermediate transfer medium 11 may have a single layer configuration or a laminated configuration.

The first ink application unit 12 applied the first ink 21 including the first liquid to the intermediate transfer medium 11 in the first ink application step.

The first ink application unit 12 may be, for example, a bar coater, a spreading roller or a brush; however, in the configuration shown in the drawing, the unit is a printing head (droplet ejecting head) performing ejection of droplets using an ink jet method. In so doing, the first ink 21 may be applied efficiently and selectively to a predetermined region (region corresponding to a region to which the second ink 22 is applied) of the intermediate transfer medium 11, and it is possible to suppress the usage amount of the first ink 21 while making the productivity of the recorded matter particularly superior, and is preferable from the viewpoint of resource savings.

A piezo method, or a method ejecting ink due to foam (bubble) generated by heating the ink may be used as the droplet ejection method (ink jet method); however, from the viewpoint of preventing involuntary volatilizing of the first liquid configuring the first ink 21, difficulty in changing the quality of the first ink 21, and the like, the piezo method is preferable.

It is preferable that the thickness of the first ink 21 applied to the intermediate transfer medium 11 be 0.1 μm or more to 5 μm or less.

Moreover, the first ink 21 will be described later in detail.

In the second ink application step, the second ink application unit 13 applies a second ink 22 including a coloring agent, thermoplastic resin and volatile second liquid to locations on the intermediate transfer medium 11 to which the first ink 21 is applied.

In addition, the second application unit 13 is a printing head (droplet ejection head) performing ejection of droplets using an ink jet method. In so doing, it is possible to apply the second ink 22 in a desired pattern, and it is possible to appropriately form the printing portions in a fine pattern in the recorded matter ultimately obtained. In addition, because the ink jet method has superior on-demand qualities and does not require a plate, the method is appropriately applicable to small lot production and multiproduct production.

In the configuration shown in the drawing, the manufacturing device 100 includes as the second ink application unit 13, a second ink application unit 13C ejecting a bluish-purple (cyan) second ink 22, a second ink application unit 13M ejecting a reddish-purple (magenta) second ink 22, a second ink ejection unit 13Y ejecting a yellow second ink 22, a second ink application unit 13W ejecting a white second ink 22 and a second ink application unit 13K ejecting a black second ink 22. In so doing, it is possible to widen the color regions expressed in the printing portions of the recorded matter ultimately obtained.

A piezo method, or a method ejecting ink due to foam (bubble) generated by heating the ink may be used as the droplet ejecting method (ink jet method); however, from the viewpoint of difficulty in changing the quality of the second ink 22, and the like, the piezo method is preferable.

The first heating unit 14 heats the second ink 22 on the intermediate transfer medium 11 in the first heating step. In particular, the first heating unit 14 heats the second ink 22 via the intermediate transfer medium 11; in other words, the unit heats the surface of the intermediate transfer medium 11 to which the second ink 22 is applied from the opposite surface side. In so doing, it is possible to reliably prevent only the outer surface of the second ink 22 applied to the intermediate transfer medium 11 being dried, and liquid (second liquid or the like) being trapped inside the film-like second ink 22, and to efficiently remove the second liquid from the entirety of the second ink 22. As a result, the stability of the shape of the second ink 22 improves and it is possible to reliably prevent disturbance in the pattern using the second ink from occurring during transfer or the like. Accordingly, it is possible to reliably and efficiently manufacture a recorded matter having printing portions in a desired shape. In particular, it is possible to make the content rate of the second liquid low in a region in the vicinity of the surface of the second ink 22 opposing the intermediate transfer medium 11, it is possible to cause second liquid to remain in the vicinity of the outer surface (surface of the opposite side to the side opposing the intermediate transfer medium 11) of the second ink 22 while making the release characteristics of the second ink 22 from the intermediate transfer medium 11 excellent, and the fixity of the second ink 22 to the recording medium 23 may be made excellent.

As the first heating unit 14, for example, an infrared heater (IR heater), a warm air heater, a halogen lamp, ceramic heater or the like may be used; however, among these, it is preferable to use an infrared heater.

Heating (heating in the first heating step) of the second ink 22 using the first heating unit 14 may volatilize all of the second liquid configuring the second ink 22; however, it is preferable to volatilize only a part thereof. In so doing, the second liquid which remains functions as a barrier, and it is possible to effectively prevent volatilizing of the first liquid in the first heating step. As a result, it is possible to more remarkably exhibit the effect due to the first liquid as described above.

The heating temperature (heating temperature in the first heating step) of the second ink 22 using the first heating unit 14 is preferably lower than the heating temperature (heating temperature in the second heating step) of the second ink 22 using the second heating unit 15. In so doing, on the intermediate transfer medium 11, the thermoplastic resin configuring the second ink 22 is softened, and it is possible to reliably prevent the occurrence of disturbance in the pattern using the second ink 22.

The heating temperature of the second ink 22 using the first heating unit 14 differs according to the composition and the like of the second ink 22; however, it is preferably 40° C. or higher to 200° C. or less, and more preferably 50° C. or higher to 150° C. or less.

Through the press roller 17A provided on the inner circumferential surface side of the intermediate transfer medium 11 and the press roller 17B also having a function as a transport unit (recording medium transport unit) of the recording medium 23, the transfer portions are configured by the second ink 22 being transferred from the intermediate transfer medium 11 to the recording medium 23. In the transfer portions, the recording medium 23 deforms so as to follow the surface shape of the press roller 17B (recording medium transport unit).

In transfer portions, the shape of the intermediate transfer medium and the shape of the recording medium (shape of the recording medium transport unit) may be any shape, for example, at least any one of them may be a planar shape; however, in the configuration shown in the drawing, the intermediate transfer medium 11 and the recording medium 23 are mutually curved in a convex shape toward the other side. In so doing, it is possible to more efficiently perform transfer (transferring step) of the second ink 22, and the productivity and yield of the recorded matter may be particularly superior. In addition, it is possible to make the fixing strength in the printing portions of the recorded matter particularly superior. In addition, this is advantageous from the viewpoint of size reductions of the manufacturing device 100.

In addition, in the transfer portions, in the locations to which the second ink 22 is transferred in the transferring step, it is preferable that the curvature of the intermediate transfer medium 11 be larger than the curvature of the recording medium 23. In so doing, it is possible to more efficiently perform transfer (transferring step) of the second ink 22, and the productivity and yield of the recorded matter may be particularly superior. In addition, it is possible to make the fixing strength in the printing portions of the recorded matter particularly superior.

The second heating unit 15 heats the second ink 22 transferred to the recording medium 23 in the second heating step. In so doing, it is possible for the thermoplastic resin configuring the second ink 22 transferred to the recording medium 23 to be softened, and it is possible to make the fixing strength with respect to the formed printing portions of the recording medium 23 sufficiently superior. In addition, it is possible to reliably prevent the first liquid and the second liquid remaining on the recorded matter ultimately obtained.

When the heating temperature (heating temperature in the first heating step) of the second ink 22 using the first heating unit 14 is $T_1$ (° C.), and the heating temperature of the second ink 22 (heating temperature in the second heating step) using the second heating unit 15 is $T_2$ (° C.), it is preferable that the relationship $0 \leq T_2 - T_1 \leq 50$ be satisfied, and more preferable that the relationship $10 \leq T_2 - T_1 \leq 30$ be satisfied. In so doing, on the intermediate transfer medium 11, the thermoplastic resin configuring the second ink 22 is softened and it is possible to make the fixing strength of the printing portions to the recording medium 23 particularly superior while preventing the occurrence of disturbance in the pattern using the second ink 22.

The heating temperature of the second ink 22 using the second heating unit 15 differs according to the composition and the like of the second ink 22; however, it is preferably 40° C. or higher to 250° C. or less, and more preferably 60° C. or higher to 180° C. or less.

In the configuration shown in the drawing, the second heating unit 15 heats the second ink 22 from the surface of the opposite side to the surface of side of the recording medium 23 to which the second in 22 is transferred. In so doing, the parts of the second ink 22 contacting the recording medium 23 may be softened more reliably and more efficiently, and it is possible to make the fixing strength with respect to the printing portion of the recording medium 23, and the durability and reliability of the recorded matter particularly superior.

As the second heating unit 15, for example, an infrared heater (IR heater), a warm air heater, a halogen lamp, ceramic heater or the like may be used; however, among these, it is preferable to use an infrared heater.

In addition, the manufacturing device 100 includes, further to the downstream side than the printing portion, a cleaning unit 18 cleaning the intermediate transfer medium 11. In so doing, it is possible to prevent both the first ink 21 and the second ink 22 being attached in a state where foreign material (for example, constituent components of the second ink 22 or residue of modified materials thereof) is attached to the recording medium 23, and it is possible to manufacture a highly reliable recorded matter, repeatedly, over an extended period.

Next, the first ink, second ink and recording medium used in the invention will be described in detail.

First Ink

The first ink 21 includes a volatile first liquid.

Further, at least a portion of the first ink 22 applied to the transfer medium 11 in the first ink application step remains on the locations on the intermediate transfer medium 11 to which the second ink 22 is applied in the second ink application step. In so doing, it is possible to exhibit the effects as described above.

It is preferable that the first ink 21 reduce the surface free energy of the intermediate transfer medium 11. In so doing, it is possible to make the transferability of the second ink 22 from the intermediate transfer medium 11 to the recording medium 23 particularly superior, to make the productivity of the recorded matter particularly superior, and to more reliably form a printing portion in a desired shape.

Moreover, for the surface free energy value, measurement of the contact angle was performed using three types of liquid for which the surface free energy and the value of each component is known, and these values were determined using the Young-Dupre method and the extended Fowkes method. As the device, a solid surface energy analyzer CA-XE (manufactured by Kyowa Interface Science Co, Ltd) is used, and calculation of the measurement and the surface free energy is performed.

In addition, the boiling point $T_{bp1}$ of the first liquid is preferably 50° C. or more to 150° C. or less, and more preferably 70° C. or more to 100° C. or less. In so doing, it is possible to more reliably prevent the occurrence an adverse influence due to first liquid remaining on the recorded matter finally obtained, and to make the transferability of the second ink 22 from the intermediate transfer medium 11 to the recording medium 23 more reliably superior.

Examples of the first liquid include, for example, methanol (boiling point 65° C.), ethanol (boiling point 78° C.), ethyl acetate, methyl ethyl ketone (80° C.), 2-propanol (boiling point 82° C.), 2-methyl-propan-1-ol (boiling point 108° C.), toluene (boiling point 111° C.), 1-butanol (boiling point 118° C.), n-butyl acetate (boiling point 126° C.), ethylene glycol monomethyl ether (boiling point 124° C.), ethylene glycol dimethyl ether (boiling point 85° C.), ethylene glycol monoethyl ether (boiling point 135° C.), ethylene glycol monomethyl ether acetate (boiling point 145° C.), propylene glycol dimethyl ether (boiling point 97° C.), 2,3,-butanediol (boiling point 77° C.), and the like; and one type or two or more types used in combination selected therefrom may be used.

Among these, it is preferable that the first liquid be a monovalent alcohol. In so doing, it is possible to make the transferability of the second ink 22 from the intermediate transfer medium 11 to the recording medium 23 particularly superior, and to make the productivity of the recorded matter particularly superior, along with being capable of more reliably forming a printing portion in a desired shape. In addition, it is possible to more reliably prevent first liquid remaining on the recorded matter finally obtained. In addition, ethanol is a material which is able to reliably exhibit the effects of the invention even in a case of small usage amounts, and additionally has little burden on the environment. Accordingly, it is preferable from the viewpoint of environmental protection.

It is preferable that the surface tension of the first ink 21 be lower than the surface tension (critical surface tension) of the intermediate transfer medium 11, and lower than the surface tension of the second ink 22. In so doing, since it is possible in the second ink application step to prevent involuntary spreading wetness of the second ink 22 on the intermediate transfer medium 11, and to form a film using a uniform first ink 21 in the first ink application step, it is possible to more appropriately perform transfer from the intermediate transfer medium 11 to the recording medium 23 of the pattern using the second ink 22 and to make the pattern using the second ink 22 more reliably in a desired shape.

The first ink 21 may include other components in addition to the above-described first liquid. Example of the type of component include, for example, a moisturizing agent, a preservative, a fungicide, a pH adjuster, an antioxidant, a metal trapping agent, a moisturizing agent, a surfactant, a filler, an adhesion promoter, or the like.

The content rate of the first liquid in the first ink 21 is preferably 50 mass % or greater, and more preferably 70 mass % or greater. In so doing, even in a case where the usage amount of the first ink 21 is suppressed, the effects of using the first ink 21 in the invention as described above are sufficiently exhibited. In addition, since it is possible to suppress the usage amount of the first ink 21, the productivity of the recorded matter may be made particularly superior and, additionally, it is preferable from the viewpoint of resource saving. Moreover, in a case where the first ink 21 includes plural types of components as the first liquid, it is preferable that the sum of the content rates thereof satisfy the conditions described above.

Second Ink

The second ink 22 includes a coloring agent, a thermoplastic resin and a volatile second liquid. The second ink 22 is used in the formation of printing portions of the recorded matter.

Coloring Agent

As the coloring agent, various pigments and various dyes may be used; however, using a pigment is particularly preferable. In so doing, it is possible to make the light resistance, heat resistance and the like of the printing portions particularly superior, and to maintain a stable external appearance across and extended period of time.

The manufacturing device 100 of the configuration shown in the drawing uses a bluish-purple (cyan) second ink 22, a reddish-purple (magenta) second ink 22, a yellow second ink 22, a white second ink 22, and a black second ink 22, as the second ink 22.

The respective colors of second ink 22 ordinarily contain a coloring agent of a color corresponding to the respective ink.

Examples of pigments configuring the chromatic second ink 22 (bluish-purple (cyan) second ink 22, reddish-purple (magenta) second ink 22, yellow second ink 22) include, for example, quinacridone-based pigments, quinacridone-quinone-based pigments, dioxazine-based pigments, phthalocyanine-based pigments, anthrapyrimidine-base pigments, anthanthrone-based pigments, indanthrone-based pigments, flavanthrone-based pigments, perylene-base pigments, diketo-pyrrolo-pyrrole-based pigments, perinone-based pigments, quinophthalone-based pigments, anthraquinone-based pigments, thioindigo-based pigments, benzimidazolone-based pigments, isoindolinone-based pigments, azomethine-based pigments or azo-based pigments, and the like.

In particular, examples of pigments (bluish-purple pigment) configuring the bluish-purple (cyan) second ink 22 include, for example, C.I. Pigment Blue-1, 2, 3, 15:3, 15:4, 15:34, 16, 22, 60; C.I. Vat Blue-4, 60, and the like, and is preferably C.I. Pigment Blue-15:3, 15:4, or 60.

In addition, examples of pigments configuring the reddish-purple (magenta) second ink 22 include, for example, C.I. Pigment Red 5, 7, 12, 48 (Ca), 48 (Mn), 57 (Ca), 57:1, 112, 122, 123, 168, 184, 202; C.I. Pigment Violet 19 and the like, and is preferably C.I. Pigment Red 122, 202, 209; or C.I. Pigment Violet 19.

In addition, examples of pigments configuring the yellow second ink 22 include, for example, C.I. Pigment Yellow 1, 2, 3, 12, 13, 14C, 16, 17, 73, 74, 75, 83, 93, 95, 97, 98, 119, 110, 114, 128, 129, 138, 150, 151, 154, 155, 180, 185, 14, 34, 35, 35:1, 37, 37:1, 42, 43, 53, 55, 81, 94, 108, 109, 110, 139, 153, 157, 168, 184 and the like, and is preferably C.I. Pigment Yellow, 74, 109, 110, 128 or 138.

In addition, chromatic pigments other than the above may be used. Examples of such pigments include, for example, C.I. Pigment Red 2, 3, 17, 22, 23, 38, 81, 48:1, 48:2, 48:3, 48:4, 49:1, 52:1, 53:1, 63:1, 144, 146, 149, 166, 170, 176, 177, 178, 179, 185, 207, 209, 254, 101, 102, 105, 106, 108, 108:1; C.I. Pigment Green 7, 15, 17, 18, 19, 26, 36, 50; C.I. Pigment Blue 15, 15:1, 15:2, 15:6, 17:1, 18, 27, 28, 29, 35, 36, 80; C.I. Pigment Violet 1, 3, 23, 50, 14, 16; C.I. Pigment Orange 5, 13, 16, 36, 43, 20, 20:1, 104; or C.I. Pigment Brown 25, 7, 11, 33.

In addition, examples of pigments configuring the white second ink 22 include, for example, titanium oxide (for example, chloride process titanium oxide (rutile type) CR-50 (product name, manufactured by ISHIHARA SANGYO KAISHA, Ltd) or the like), barium sulfate, a hollow white resin emulsion, or the like.

In addition, examples of pigments configuring the black second ink 22 include, for example, carbon blacks. Specifically, examples include No. 2300, 900, MCF 88, No. 20B, No. 33, No. 40, No. 45, No. 52, MA7, MA8, MA100, No. 2200B (all product names, manufactured by Mitsubishi Chemical Corporation) or the like; Color Black FW1, FW2, FW2V, FW18, FW200, 5150, 5160, 5170, Pretex 35, U.V. 140U, Special Black 6, 5, 4A, 4, 250 (all product names, manufactured by Degussa AG) or the like; Conductex SC, Raven 1255, 5750, 5250, 5000, 3500, 1255, 700 (all product names, manufactured by Columbian Carbon Co., Ltd) or the like; Regal 400R, 330R, 660R, Mogul L, Monarch 700, 800, 880, 900, 1000, 1100, 1300, 1400, Elf Tex 12 (all product names, manufactured by Cabot Corporation) or the like.

Moreover, in one type of ink, the color may be adjusted by using plural types of coloring agent components in combination. More specifically, for example, the black second ink 22 may use two or more types of coloring agent components other than black, and may present as black overall.

In addition, pigments or the like having a glossy feeling, such as, for example, metallic powder or the like, may be used as the coloring agent.

In addition, the pigment may undergo a surface treatment. In so doing, it is possible to improve adjustment of hue, dispersion stability of pigment particles in the second ink 22, ejection stability and storage stability of the second ink 22, or the like.

The content rate of coloring agent in the second ink 22 is not particularly limited; however, it is preferably 0.5 mass % or greater to 10 mass % or less.

Thermoplastic Resin

The thermoplastic resin is a component contributing to fixing of the printing portion using the second ink 22 to the recording medium 23.

The thermoplastic resin may have solubility or may not have solubility (be insoluble) with respect to the second liquid.

In addition, a so-called resin emulsion may be used as the thermoplastic resin.

In a case where a resin emulsion is used as the thermoplastic resin, the particle diameter is not particularly limited; however, it is preferably 150 nm or lower, and more preferably 5 nm or greater to 100 nm or less.

As the thermoplastic resin, specifically, acrylic polymers, for example, polyacrylic ester or copolymers thereof, polymethacrylic acid ester or copolymers thereof, polyacrylonitrile or copolymers thereof, polycyanoacrylate, polyacrylamide, polyacrylic acid, or polymethacrylic acid; polyolefin-based polymers, for example, polyethylene, polypropylene, polybutene, polyisobutylene, polystyrene or copolymers thereof; a petroleum resin, cumarone-indene resin or a terpene resin; vinyl acetate-vinyl alcohol-based copolymers, for example, polyvinyl acetate or copolymers thereof, polyvinyl alcohol, polyvinyl acetal, or polyvinyl ether; halogen-containing series polymers, for example, polyvinyl chloride or copolymers thereof, polyvinylidene chloride, a fluororesin or a fluororubber; nitrogen-containing vinyl polymers, for example, polyvinyl carbazole, polyvinylpyrrolidone or copolymers thereof, polyvinylpyridine, or polyvinylimidazole; diene based polymers, for example, polybutadiene or copolymers thereof, polychloroprene or polyisoprene (butyl rubber); or other ring-opening polymerization type resins, condensation polymerization-type resins or natural macromolecular resins, or the like may be used.

Furthermore, for example, Hitec E-7025P, Hitec E-2213, Hitec E-9460, Hitec E-9015, Hitec E-4A, Hitec E-5403P, Hitec E-8237 (all product names, manufactured by Toho Chemical Industry Co., Ltd.), AQUACER 507, AQUACER 515, AQUACER 840 (all product names, manufactured by BYK Japan KK), or the like may be used.

In a case the thermoplastic resin is obtained in an emulsion state, it is possible to prepare the particles by mixing a surfactant and water according to the case. For example, an emulsion of acrylic resin or styrene-acrylic acid copolymer based resin may be obtained by mixing a (meth)acrylic acid ester resin or styrene-(meth)acrylic acid ester resin, a (meth) acrylic acid resin according to the case, and a surfactant in water. The proportions of the mixture of resin components and surfactant is preferably, ordinarily, from 50:1 to 5:1. When the usage amount of surfactant is below the lower limit value, it is difficult to form the emulsion, and additionally, when exceeding the upper limit value, there is a tendency for the water resistance of the second ink 22 to reduce, and for the fixity of the printing portions with respect to the recording medium 23 to deteriorate.

The surfactant used herein is not particularly limited and examples thereof include, for example, anionic surfactants (for example, sodium dodecylbenzene sulfonate, sodium laurylate, ammonium salts of polyoxyethylene alkyl ether sulfate, and the like), nonionic-based surfactants (for example, polyoxyethylene alkyl ethers, polyoxyethylene alkyl esters, polyoxyethylene sorbitan fatty acid esters, polyoxyethylene alkyl phenyl ether, polyoxyethylene alkyl amines, polyoxyethylene alkylamides and the like), and the like.

In addition, the emulsion of the thermoplastic resin may also be obtained through emulsion polymerization of monomers of the above-described resin components in water in the presence of a polymerization catalyst and an emulsifier.

As the polymerization initiator, those identical to ones used in ordinary radical polymerization may be used, and examples thereof include, for example, potassium persulfate, ammonium persulfate, hydrogen peroxide, azobisisobutyronitrile, benzoyl peroxide, dibutyl peroxide, peracetic acid, cumene hydroperoxide, hydroxy-t-butyl peroxide, hydroxy para menthane peroxide and the like. In a case when the polymerization reaction is performed in water, a water-soluble polymerization initiator is preferable. Examples of the emulsifier include, for example, in addition to sodium lauryl sulfate, generally used anionic surfactants, nonionic surfactants, or amphoteric surfactants, and mixtures thereof.

As the thermoplastic resin, in a case where a resin emulsion is used, a known resin emulsion may also be used. For example, resin emulsions disclosed in JP-B-62-1426, JP-A-3-56573, JP-A-3-79678, JP-A-3-160068 or JP-A-4-18462 may be used as is. In addition, it is also possible to use commercially available resin emulsions, examples of which include, for example, Microgel E-1002, E-5002 (styrene-acrylic based resin emulsions; manufactured by Nippon Paint Co., Ltd), Voncoat 4001 (acrylic resin emulsion; manufactured by Dainippon Ink and Chemicals, Inc.), Voncoat 5454 (styrene-acrylic resin emulsion; manufactured by Dainippon Ink and Chemicals, Inc.), SAE-1014 (styrene-acrylic resin emulsion; manufactured by Zeon Japan Co., Ltd.), Saibinol SK-200 (acrylic resin emulsion; manufactured by Saiden Chemical Industry Co., Ltd), and the like.

As a water-soluble resin, examples include water-insoluble ones from polymers among polyethylene glycol, polyvinylpyrrolidone, polyvinyl alcohol, polyvinyl acetal or the like.

The content rate of thermoplastic resin in the second ink 22 is preferably 0.5 mass % or more to 20 mass % or less, and more preferably 1.5 mass % or more to 15 mass % or less. When the content rate is less than the lower limit, there is a tendency for the fixity of the printing portions formed with respect to the recording medium 23 to reduce. When the content rate exceeds the upper limit, there is a possibility of the storage stability of the second ink 22 reducing.

Second Liquid

The second liquid has volatility. In so doing, the second liquid, in the manufacturing (for example, the first heating step, the second heating step) of the recorded matter, is removed, and it is possible to make the durability and reliability of the recorded matter ultimately obtained particularly superior. Moreover, in a case where the second ink 22 includes plural types of volatile liquid components, the one with the highest content rate in the second ink 22 is the second liquid.

In addition, the boiling point $T_{bp2}$ of the second liquid is preferably 70° C. or more to 150° C. or less, and more preferably 80° C. or more to 120° C. or less. In so doing, in the first heating step, the second liquid may be moderately volatilized, and it is possible to more reliably prevent the first liquid volatilizing in the first heating step and to more effectively improve the stability of the shape of the second ink 22. In addition, in the second heating step, the second liquid may be more reliably removed, and it is possible to more reliably prevent the occurrence of adverse influence due to remaining of the second liquid on the recorded matter ultimately obtained.

In addition, when the boiling point of the first liquid is $T_{bp1}$ (° C.) and the boiling point of the second liquid is $T_{bp2}$ (° C.), it is preferable that the relationship of $5 \leq T_{bp2} - T_{bp1}$ be satisfied, and more preferable that the relationship $15 = T_{bp2} - T_{bp1}$ be satisfied. By satisfying such a relationship, it is possible to make the separability of a pattern using the second ink 22 formed on the intermediate transfer medium 11 from the intermediate transfer medium 11 particularly superior, and the transferability to the recording medium (target transfer medium) 23 particularly superior.

Examples of the second liquid include, for example, water, ethanol (boiling point 78° C.), methyl lactate (boiling point 145° C.), ethylene glycol monomethyl ether (boiling point 124° C.), ethylene glycol dimethyl ether (boiling point 85° C.), ethylene glycol monomethyl ether acetate (boiling point 145° C.), propylene glycol monomethyl ether (boiling point 120° C.), propylene glycol dimethyl ether (boiling point 97° C.), 1,4-dioxane (boiling point 101° C.), 2,3-butanediol (boiling point 77° C.), n-butanol (boiling point 118° C.) and the like.

Among these, it is preferable that the second ink 22 include water as the second liquid. In so doing, in the first heating step, the second liquid may be moderately volatilized, and it is possible to more reliably prevent the first liquid volatilizing in the first heating step and to more effectively improve the stability of the shape of the second ink 22. In addition, in the second heating step, the second liquid may be more reliably removed, and it is possible to more reliably prevent the occurrence of adverse influence due to remaining of the second liquid on the recorded matter ultimately obtained. In addition, water is a material with particularly small burden on the human body or the environment. Accordingly, it is preferable from the viewpoint of worker safety and environmental protection.

In particular, in a case where the above-described first liquid is ethanol, by including water as the second liquid, because ethanol and water are highly mutually soluble, after the second ink is attached, the occurrence of cissing or irregularity is effectively suppressed, and it is possible to more reliably form a higher quality printing portion. Furthermore, because ethanol, which has a lower boiling point than water, is easily volatilized by heating, the second ink 22 is stabilized and may be transferred to the recording medium 23 in subsequent transfer portions.

The content rate of the second liquid in the second ink 22 is preferably 50 mass % or more to 90% to less, and more preferably 60 mass % or more to 85 mass % to less. In so doing, in the first heating step, it is possible for the second liquid to be moderately volatilized along with enabling the ejection stability of the second ink 22 to be particularly superior, and it is possible to more reliably prevent the volatilizing of the first liquid in the first heating step and to effectively improve the stability of the shape of the second ink 22. In addition, in the second heating step, the second liquid may be more reliably removed, and it is possible to more reliably prevent the occurrence of adverse influence due to remaining of the second liquid on the recorded matter ultimately obtained.

Other Liquid Components

In addition to the above-described second liquid, the second ink 22 may include other liquid components. In so doing, for example, it is possible to increase the solubility of the thermoplastic resin in the second ink 22, and to make the strength of the printing portions formed particularly superior, prevent drying of the ink jet head, and enable stable droplet ejection over a longer period of time.

Examples of such liquid components (other liquid components) include, for example, n-methylpyrrolidone, n-ethyl pyrrolidone, n-vinyl pyrrolidone, 2-pyrrolidone, dimethyl sulfoxide, ϵ-caprolactam, methyl lactate, ethyl lactate, isopropyl lactate, butyl lactate, ethylene glycol monomethyl ether, ethylene glycol dimethyl ether, ethylene glycol monomethyl ether acetate, diethylene glycol monomethyl ether, diethylene glycol dimethyl ether, diethylene glycol ethyl methyl ether, diethylene glycol diethyl ether, diethylene glycol isopropyl ether, propylene glycol monomethyl ether, propylene glycol dimethyl ether, dipropylene glycol monomethyl ether, dipropylene glycol dimethyl ether, 1,4-dioxane, diethylene glycol, propylene glycol, dipropylene glycol, 1,3-propanediol, 1,4-butanediol, hexylene glycol, 2,3-butanediol, ethanol, n-propanol, iso-propanol, n-butanol, 1,2-hexanediol, 1,3-hexanediol, 1,2-heptane diol, 1,3-heptane diol, 1,2-octane diol, 1,3-octane diol, 1,2-pentanedial, triethylene glycol monobutyl ether, diethylene glycol monobutyl ether, diethylene glycol monopropyl ether, diethylene glycol monopentyl ether, propylene glycol monobutyl ether, and the like, and one kind or two or more kinds selected therefrom may be used. Of these, the second ink 22 preferably includes, as the other liquid component, one kind or two or more kinds selected from a group formed of 1,2-hexanediol, 2-pyrrolidone and propylene glycol, more preferably includes two or more kinds selected therefrom, and even more preferably includes all three types of these components. In so doing, it is possible to more remarkably exhibit the effects as described above.

Other Components

The second ink 22 may include components other than the above (other components). Example of such components include, for example, a preservative, a fungicide, a pH adjuster, an antioxidant, a metal trapping agent, a moisturizing agent, a dispersant, a dispersion assistant, a surfactant, a filler, an adhesion promoter, a deflocculating agent, a photocuring resin, a thermosetting resin, a polymerization initiator, a polymerization-inhibitor or the like.

Examples of the preservative and fungicide include, for example, sodium benzoate, sodium pentachlorophenolate, 2-pyridine-thiol-1-sodium oxide, sodium sorbate, dehydro sodium acetate, 1,2-benzisothiazolin-3-one (Proxel CRL, Proxel BDN, Proxel GXL, Proxel XL-2, Proxel TN by ICI PLC) and the like.

Examples of the pH adjuster include, for example, sodium hydroxide, inorganic alkalis such as potassium hydroxide, ammonia, diethanolamine, triethanolamine, triisopropanolamine, morpholine, potassium dihydrogen phosphate or disodium hydrogen phosphate, and the like.

Examples of the metal trapping agent include, for example, ethylenediaminetetraacetic acid disodium and the like.

Through the second ink 22 including a surfactant, it is possible to improve the droplet ejection stability using the ink jet method.

As the surfactant, it is preferable that, for example, silicone surfactants, such as polyester-modified silicone or polyether-modified silicone be used, and more preferable that polyether modified polydimethylsiloxane or polyester-modified polydimethylsiloxane be used. Specific examples include, BYK-347, 348, BYK-UV3500, 3510, 3530, 3570 (all manufactured by BYK Japan KK); however, they are not limited thereto.

Recording Medium

Examples of the recording medium 23 include, for example, papers, such as ordinary paper, art paper, coated paper, matte paper, or dedicated ink jet paper; compacts (films and the like) configured from a plastic material, such as polyethylene terephthalate, polycarbonate, polystyrene, polyurethane, polyethylene, polypropylene; compacts (films and the like) formed from a metal; compacts (films and the like) configured from a ceramic; natural fibers or composite fibers and non-woven fabrics, such as cotton, polyester, wool and the like.

As the recording medium 23, those that are non-absorbent or have low absorbency to ink may be suitably used. In the recording method using an intermediate transfer method of the related art, in a case where a recording medium which is non-absorbent or has low absorbency to ink is used, problems such as being unable to reliably form printing portions with a desired shape occur particularly remarkably; however, in the invention, the occurrence of such problems may be reliably prevented even when the recording medium is one which is non-absorbent or has low absorbency to ink. In other words, in a case where the recording medium is non-absorbent or has low absorbency to ink, the effects of the invention are more remarkably exhibited.

Here, a "non-absorbent or low absorbency to ink" recording medium is a recording medium in which, in the Bristow method, the water absorption amount of the printing surface from the start of contact up to 30 msec is 10 ml/m$^2$ or less. The Bristow method is the method in the most widespread use as a method of measuring a liquid absorption amount in a short time, and is also employed by the Japan Technical Association of the Pulp and Paper Industry (JAPAN TAPPI). The details of the test method are disclosed in the standard No. 51 "Paper and Cardboard—Liquid Absorbency Test Method—Bristow Method" of the "JAPAN TAPPI Paper and Pulp Test Methods 2000 Edition".

It is preferable that the recording medium 23 be a film (including ones formed in a cylindrical or bag-like shape) configured from a plastic material. In the related art, in a case where a recording medium is a film composed from a plastic material, it is difficult to reliably form printing portions in a desired shape, and additionally, problems of it being difficult to make the fixity of the printing portions to the printing medium sufficiently superior occur particularly remarkably. In contrast, according to the invention, it is possible to reliably prevent the occurrence of the above problems even in cases where the recording medium is a film composed from a plastic material. In other words, in a case where the recording medium is a film composed from a plastic material, the effects according to the invention are more remarkably exhibited.

Above, in the manufacturing method and the manufacturing device of the invention, fixity is excellent, and it is possible to reliably and efficiently manufacture the recorded matter provided with printing portions having a desired shape.

Recorded Matter

Next, the recorded matter of the invention will be described.

The recorded matter of the invention is manufactured using the method of manufacturing of the invention. In so doing, a recorded matter may be provided with superior fixity and include printing portions having a desired shape.

The recorded matter of the invention is suitable to any application, for example, a packaging material for a variety of products, such as food products and everyday items, and various decorations and the like.

Above, the invention has been described based on preferred embodiments; however, the invention is not limited thereto.

For example, in the embodiments described previously, a case in which the intermediate transfer medium is an endless belt is described as representative; however, in the aspects of the invention, the intermediate transfer medium may be any shape, and, for example, may be a drum shape (roll shape).

In addition, the respective portions configuring the manufacturing device of the inventions may be substituted with arbitrary configurations able to exhibit the same functions. In addition, arbitrary constituent matters may be applied. For example, the manufacturing device of the invention may be provided with a recovery mechanism recovering one or both of the first and second liquid.

In addition, the manufacturing device of the invention may further have, in addition to the above-described steps, other steps (preprocessing, intermediate processing, post-processing).

EXAMPLES

1. Manufacturing of Recorded Matter

The recorded matter was manufactured as described below.

Embodiment 1

First, a manufacturing device as shown in FIG. 1 was prepared.

The intermediate transfer medium configuring the manufacturing device was configured of a 100 μm Teijin Tetoron Film G2 transparent PET film (manufactured by Teijin DuPont Films Japan Ltd.) In addition, in the transfer portion, the curvature of the intermediate transfer medium was larger than the curvature of the press roller as the recording medium transport unit.

First Ink Application Step

First, according to the ink jet method, ethanol (boiling point: 78° C.) as the first ink was ejected in a predetermined pattern towards the intermediate transfer medium from the first ink application unit. Such a first ink causes the surface free energy of the intermediate transfer medium to be reduced. In addition, in this step, the thickness of the layer using the first ink was 1 μm.

Second Ink Application Step

Next, according to the ink jet method, the second ink was applied selectively toward locations on the intermediate transfer medium to which the first ink was applied from the second ink application unit. As the second ink, five types of black ink, bluish-purple (cyan) ink (cyan ink), reddish-purple (magenta) ink (magenta ink), yellow ink and white ink were used. At this time, the respective colors of second ink were not overlapped.

Each ink (second ink) was prepared as below.

Preparation of Second Ink

The second liquid was set to water.

Black Ink A-1

Four parts by mass of diethylene glycol monobutyl ether (hereinafter, referred to as "DEGmBE"), one part by mass of BYK-348 (silicone based surfactant, product name manufactured by BYK Japan KK), and 30 parts by mass of ion exchange water were mixed, and stirred for 20 minutes at room temperature, thereby obtaining a pre-mix liquid. Next, as a water-soluble resin, 5 parts per mass of JONCRYL 678 (acrylic-based water-soluble resin, product name manufactured by BASF Ltd., molecular weight 8500, acid value 215), and as a pH adjuster, 0.1 parts by mass of potassium hydroxide (KOH) were added to the pre-mix liquid and stirred for 1 hour at 40° C.

A mixed liquid was obtained by adding 10 parts by mass of Carbon Black MA 100 (product name manufactured by Mitsubishi Chemical Corporation) to the liquid after stirring, and was stirred and dispersed for 2 hours in a tabletop sandmill (manufactured by Hayashi Shoten) for at 2160 rpm along with 1.5 times the mass of the mixed liquid of zirconia glass beads (diameter 1.5 mm). After dispersion, the liquid was filtered with a SUS mesh filter with a 0.1 mm diameter, and the dispersion liquid was prepared.

To the dispersion liquid, 2-pyrrolidone (hereinafter, referred to as "2-Py"), propylene glycol (hereinafter, referred to as "PG"), Polysol AM-710 (acrylic resin emulsion, product name manufactured by Showa Denko KK, average particle diameter 150 nm, effective component 50.5 mass %) as a resin emulsion, Proxel-XL2 (preservative, product name manufactured by Arch Chemicals Inc.), and ion exchange water were added in the quantities (parts by mass) shown in Table 1, and stirred for 20 minutes at 40° C. After stirring, the liquid was filtered using a membrane filter with a 5 μm diameter, and the black ink was prepared having the composition shown in Table 1.

Cyan Ink A2

Three parts by mass of DEGmBE, 0.7 parts by mass of BYK-348, and 30 parts by mass of ion exchange water were mixed, and a pre-mix liquid was obtained by stirring at room temperature for 20 minutes. Next, 2 parts by mass of Joncryl 680 (acrylic water-soluble resin, product name manufactured by BASF Ltd, molecular weight 4900, acid value 215) as the water-soluble resin, and 0.1 mass % of KOH were added to the pre-mix liquid, and stirred for 1 hour at 40° C.

A mixed liquid was obtained by adding 5 parts by mass of cyan pigment (C.I. Pigment Blue 15:3, manufactured by DIC Corporation) to the liquid after stirring, and thereafter, a dispersion liquid was prepared by dispersion and filtering under the same conditions as the case of the black ink A-1.

To the dispersion liquid, 1,2-hexanediol (hereinafter also referred to as "1,2-HD"), 2-Py, PG, Polysol AM-2300 (styrene-acrylic resin emulsion, product name manufactured by Showa Denko KK, minimum film forming temperature (MFT) 70° C., average particle diameter 90 nm, effective component 40 mass %) as the resin emulsion, Proxel-XL2, and ion exchange water were added in the quantities (parts by mass) shown in Table 1, and thereafter, a cyan ink with the composition shown in Table 1 was prepared by stirring and filtering under the same conditions as the case of the black ink A-1.

Magenta Ink A-3

Three parts by mass of DEGmBE, 0.2 parts by mass of BYK-348, and 30 parts by mass of ion exchange water were mixed, and a pre-mix liquid was obtained by stirring at room temperature for 20 minutes. Next, one part by mass of Joncryl 680 and 0.1 mass % of KOH were added to the pre-mix liquid and stirred for one hour at 40° C.

A mixed liquid was obtained by adding 4 parts by mass of magenta pigment (C.I. Pigment Red 122, manufactured by BASF Ltd) to the liquid after stirring, and thereafter, a dispersion liquid was prepared by dispersion and filtering under the same conditions as the case of the black ink A-1.

To the dispersion liquid, 1,2-HD, AE373D (carboxy modified styrene-acrylic resin emulsion, brand name manufactured by E-Tec Co., Ltd, average particle diameter 150 nm, effective component 50 mass %), Proxel-XL2, and ion exchange water were added in the quantities shown in Table 1 (parts by mass), and thereafter, a magenta ink with the composition shown in Table 1 was prepared by stirring and filtering under the same conditions as the case of the black ink A-1.

Yellow Ink A-4

Three parts by mass of DEGmBE, 0.8 parts by mass of BYK-348, and 30 parts by mass of ion exchange water were mixed, and a pre-mix liquid was obtained by stirring at room temperature for 20 minutes. Next, 2 parts by mass of Joncryl 680 and 0.1 mass % of KOH were added to the pre-mix liquid and stirred for one hour at 40° C.

A mixed liquid was obtained by adding 4 parts by mass of yellow pigment (C.I. Pigment Yellow 180, manufactured by Dainichiseika Color & Chemicals Mfg. Co., Ltd.), and thereafter, a dispersion liquid was prepared by dispersion and filtering under the same conditions as the case of the black ink A-1.

To the dispersion liquid, 1,2-HD, 2-Py, PG, Polysol AT860 (acrylic resin emulsion, product name manufactured by Showa Denko KK, average particle diameter 120 nm, Tg 60° C., effective component 50 mass %) as the resin emulsion, Surfynol 465 (acetylene glycol-based surfactant, product name manufactured by Air Products and Chemicals Inc.), Proxel-XL2, and ion exchange water were added in the quantities (parts by mass) shown in Table 1, and thereafter, a yellow ink with the composition shown in Table 1 was prepared by stirring and filtering under the same conditions as the case of the black ink A-1.

White Ink A-5

One part by mass of BYK-348, 4.7 parts by mass of Denka Poval H-12 (polyvinyl alcohol, product name manufactured by Denki Kagaku Kogyo Kabushiki Kaisha, purity 94 mass %) and 30 parts by mass of ion exchange water were mixed, and stirred for one hour at 40° C.

A mixed liquid was obtained by adding 9.5 parts by mass of CR-50 (titanium oxide rutile, product name manufactured by Ishihara Sangyo Kaisha, Ltd., $TiO_2$ effective component 95 mass %, average particle diameter 0.25 μm) to the liquid after stirring, and thereafter, a dispersion liquid was prepared by dispersion and filtering under the same conditions as the case of the black ink A-1.

To the dispersion liquid, Takelac W-6061 (polyurethane resin emulsion, product name manufactured by Mitsui Chemicals, Inc., solid content 30 mass %) as a resin emulsion, 1,2-HD, PG, Proxel-XL2, and exchange ion water were added in the quantities (parts by mass) shown in Table 1, and stirred for 20 minutes at 40° C. After stirring, the liquid was filtered using an SUS mesh filter with a 10 μm diameter, and a white ink with the composition shown in table 1 was prepared.

The compositions of the above black ink A-1 to white ink A-5 are collected in Table 1. Moreover, in Table 1, "resin EM" means resin emulsion, and numerical values indicate the conversion quantities (parts by mass) of resin components. Blank portions mean no additions. In addition, the quantity of ion exchange water is the quantity of ion exchange water included in the obtained ink. Moreover, the surface tensions of the above A-1 to A-5 were 26 to 28 mN/m.

TABLE 1

| | | Resin | | Organic Solvent (liquid component) | | | | Surfactant | | pH | | Ion Exchange | |
|---|---|---|---|---|---|---|---|---|---|---|---|---|---|
| | Pigment | Water-soluble resin | Resin EM | DEGmBE | 1,2-HD | 2-Py | PG | BYK-348 | Surfynol 465 | Adjuster KOH | Preservative Proxel-XL2 | Water (liquid component) | Total |
| Black Ink A-1 | 10 | 5 | 0.5 | 4 | — | 4 | 1 | 1 | — | 0.1 | 0.2 | 74.2 | 100 |
| Cyan Ink A-2 | 5 | 2 | 13 | 3 | 6 | 3 | 7 | 0.7 | — | 0.1 | 0.2 | 60 | 100 |
| Magenta Ink A-3 | 4 | 1 | 0.5 | 3 | 6 | — | — | 0.2 | — | 0.1 | 0.2 | 85 | 100 |
| Yellow Ink A-4 | 4 | 2 | 0.6 | 3 | 10 | 5 | 5 | 0.8 | 1.2 | 0.1 | 0.2 | 68.1 | 100 |
| White Ink A-5 | 9.5 | 4.7 | 9 | — | 5 | — | 5 | 1 | — | — | 0.2 | 65.6 | 100 |

First Heating Step

Next, an infrared heater (IR heater) was used as the first heating unit, infrared rays were irradiated from the opposite surface side to the surface of the intermediate transfer medium to which the second ink was applied, the second ink was heated to 80° C., and a part of the second liquid was removed.

Transferring Step

Next, in the transfer portions, the second ink heated in the first heating step was transferred to a PVC film: ViewCal (manufactured by Sakurai Co., Ltd., model number VC 9700) as the recording medium. In this step, the transfer pressure was 30 kg/cm$^2$.

In the transfer portions, the curvature of the intermediate transfer medium was larger than the curvature of the recording medium. In other words, the radius of curvature of the intermediate transfer medium in the transfer portions was 30 mm, and the radius of curvature of the recording medium in the transfer portions was 50 mm.

Second Heating Step

Thereafter, an infrared heater (IR heater) was used as the second heating unit, infrared rays were irradiated from the surface of the opposite side to the side of the recording medium to which the second ink was transferred, the second ink was heated to 100° C., and, the first liquid and the remaining second liquid are removed, the thermoplastic resin was softened and the printing portions were fixed to the recording medium. In so doing, a recorded matter was obtained.

Embodiment 2

Other than using 2-propanol (boiling point: 82° C., surface tension: 23.7 mN/m) as the first ink, the recorded matter was manufactured in the same manner as Embodiment 1.

Embodiment 3

Other than using a mixed liquid of 70 parts by mass of ethanol, 29.8 parts by mass of water, 0.5 parts by mass of a mixed liquid (surface tension: 25 mN/m) BYK-348 (silicon-based surfactant, product name manufactured by BYK Japan KK) as the first ink, the recorded matter was manufactured in the same manner as Embodiment 1.

In any of the Embodiments 1 to 3, the surface tension of the first ink was smaller than the surface tension of the intermediate transfer medium, and smaller than the surface tension of the second ink.

Comparative Example 1

A manufacturing device without a first ink application unit was used, and other than not performing the first ink application step, the recorded matter was manufactured in the same manner as Embodiment 1.

Comparative Example 2

A manufacturing device without a first heating unit was used, and other than not performing the first heating step, the recorded matter was manufactured in the same manner as Embodiment 1.

Comparative Example 3

A manufacturing device without a second heating unit was used, and other than not performing the second heating step, the recorded matter was manufactured in the same manner as Embodiment 1.

Comparative Example 4

A manufacturing device in which the first heating unit was arranged on the surface side of the intermediate transfer medium to which ink was applied, and other than performing heating of the second ink from the surface side (outer surface side of the second ink) of the intermediate transfer medium to which the second ink is applied in the first heating step, the recorded matter was manufactured in the same manner as in Embodiment 1.

The configuration of the manufacturing device and the manufacturing conditions for each of the Embodiments and Comparative Examples are collected and shown in Table 2.

Moreover, in the table, in the boiling point column, boiling points at one atmosphere are shown.

TABLE 2

| | Has First Ink Ejection Unit? | Has First Heating Unit? | Has Second Heating Unit? | Curvature Radius of Intermediate Transfer Medium in Transfer Portions (mm) | Curvature Radius of Recording Medium in Transfer Portions (mm) | Boiling Point $T_{bp1}$ (° C.) of First Liquid |
|---|---|---|---|---|---|---|
| Embodiment 1 | Y | Y | Y | 30 | 50 | 78 |
| Embodiment 2 | Y | Y | Y | 30 | 50 | 82 |
| Embodiment 3 | Y | Y | Y | 30 | 50 | 85 |
| Comparative Example 1 | N | Y | Y | 30 | 50 | — |
| Comparative Example 2 | Y | N | Y | 30 | 50 | 78 |
| Comparative Example 3 | Y | Y | N | 30 | 50 | 78 |
| Comparative Example 4 | Y | Y | Y | 30 | 50 | 78 |

2 Evaluation

Evaluation relating to the recorded matter obtained as described above was performed as follows.

2.1 Evaluation of Appearance

Each of the recorded matters manufactured in each of the Embodiments and Comparative Examples was observed visually, and evaluated according to the following criteria.

A: Printing portions with a desired shape were reliably formed and printing defects due to flowing, cissing and the like were not recognized. (Excellent transferability)

B: Slight disturbance only in fine line portions of the printing portions was recognized. (Satisfactory transferability)

C: Clear disturbance recognized in the fine line portions of the printing portions; however, disturbance not recognized in other locations.

D: In addition to disturbance in the fine line portions, slight disturbance recognized in other locations.

E: In addition to disturbance in the fine line portions, clear disturbance also recognized in other locations.

2.2 Evaluation of Fixing Strength

A fastness test was performed on the solid color printing portions with a 100% duty of each ink for each recorded matter manufactured in each of the Embodiments and Comparative Examples using an AB-3015 Color Fastness Rubbing Tester Model II (manufactured by Tester Sangyo Co., Ltd.) in accordance with the method disclosed in the Japanese Industrial Standards JIS L 0849, in which a white cotton cloth in a dried state was attached to the tip of the rubbing block and reciprocated 100 times at a speed of 30 reciprocations a minute under a load of approximately 2 N/100 mm2. The density of the printing portions before and after testing was measured using an X-Rite model 404 (manufactured by X-Rite, Inc.), and the average density residual ratio was calculated for 10 locations, and determined according to the following standard. It is noted that the larger the density residual ratio, the better the fixing strength of the printing portions with respect to the recording medium.

AA: Average density residual ratio is 90% or higher

A: Average density residual ratio is from 80% or higher to less than 90%

B: Average density residual ratio is from 60% or higher to less than 80%

C: Average density residual ratio is from 40% or higher to less than 60%

D: Average density residual ratio is from 20% or higher to less than 40%

E: Average density residual ratio is less than 20%, or fixing was not possible.

The results are shown in Table 3. Moreover, based on appearance, those having a value of D or E were not worth evaluating, and are left blank (–).

TABLE 3

| | Appearance | Fixing Strength |
|---|---|---|
| Embodiment 1 | A | A |
| Embodiment 2 | A | A |
| Embodiment 3 | B | A |
| Comparative Example 1 | E | — |
| Comparative Example 2 | D | — |
| Comparative Example 3 | A | C |
| Comparative Example 4 | E | — |

As is clear from Table 3, printing portions having a desired shape are reliably formed on the recorded matter of the invention, and the fixing strength of the printing portions to the recording medium is excellent. In addition, in the invention, it is possible to manufacture a recorded matter with excellent productivity and yield. In addition, in the invention, it is possible to manufacture the recorded matter at low energy. In contrast, in the Comparative Examples, satisfactory results were not obtained.

The entire discloser of Japanese Patent Application No. 2012-050116, filed Mar. 7, 2012 is expressly incorporated by reference herein.

What is claimed is:

1. A method of manufacturing a recorded matter comprising:

applying a first ink including a volatile first liquid to an intermediate transfer medium;

applying a second ink including a coloring agent, a thermoplastic resin and a volatile second liquid using an ink jet method to locations of the intermediate transfer medium in which the first ink is applied;

heating a surface of the intermediate transfer medium to which the second ink is applied from the opposite surface side and volatilizing at least a part of the second liquid;

transferring the second ink heated in the heating of the surface of the intermediate transfer medium onto the recording medium, wherein the of relationship of boiling point of the first liquid and the second liquid is 15° C.$<T_{bp2}-T_{bp1}$ and the relationship of the first heating temperature and second heating temperature 0° C.<T2−T1<50° C.; and heating the second ink transferred to a recording medium;

wherein the boiling point $T_{bp2}$ of the second liquid is between 70° C. to 150° C. and the boiling point $T_{bp1}$ of the first liquid is from 50° C. to 150° C.

2. The manufacturing method of a recorded matter according to claim 1, wherein the first ink causes the surface free energy of the intermediate transfer medium to be reduced.

3. A recorded matter manufactured using the method according to claim 2.

4. The manufacturing method of a recorded matter according to claim 1, wherein surface tension of the first ink is lower than surface tension of the intermediate transfer medium and lower than surface tension of the second ink.

5. A recorded matter manufactured using the method according to claim 4.

6. The manufacturing method of a recording medium according to claim 1, wherein the first liquid is a monovalent alcohol.

7. A recorded matter manufactured using the method according to claim 6.

8. The method of manufacturing a recorded matter according to claim 1, wherein the second ink includes water as the second liquid.

9. A recorded matter manufactured using the method according to claim 8.

10. The method of manufacturing a recorded matter according to claim 1, wherein the applying of the first ink is performed using an ink jet method.

11. The method of manufacturing a recorded matter according to claim 1, wherein, in the locations to which second ink is transferred in the transferring, the curvature rate of the intermediate transfer medium is larger than the curvature rate of the recording medium.

12. The method of manufacturing a recorded matter according to claim 1, wherein, in the locations in which the second ink is transferred, the intermediate transfer medium and the recording medium are mutually curved in a convex shape.

13. The method of manufacturing a recorded matter according to claim 1, wherein the heating of the second ink is performed by heating the side of the recording medium to which the second ink is transferred from the surface of the opposite side.

14. The method of manufacturing a recorded matter according to claim 1, wherein the recording medium is a film configured from a plastic material.

15. A recorded matter manufactured using the method according to claim 1.

16. A manufacturing device of a recorded matter comprising, an intermediate transfer medium;

a first ink application unit applying a first ink including a volatile first liquid to the intermediate transfer medium;

a second ink application unit applying a second ink including a coloring agent, a thermoplastic resin and a volatile second liquid using an ink jet method to locations of the intermediate transfer medium to which the first ink is applied;

wherein the of relationship of boiling point of the first liquid and the second liquid is 15° C.$<T_{bp2}-T_{bp1}$ and the relationship of the first heating temperature and second heating temperature 0° C.<T2−T1<50° C.;

a first heating unit heating a surface of the intermediate transfer medium to which the second ink is applied from the opposite surface side; and a second heating unit heating the second ink transferred to a recording medium;

the boiling point $T_{bp2}$ of the second liquid is between 70° C. to 150° C. and the boiling point $T_{bp1}$ of the first liquid is from 50° C. to 150° C.

* * * * *